United States Patent [19]

Ziplies et al.

[11] 4,232,588

[45] Nov. 11, 1980

[54] ELECTRICALLY CONTROLLED PIPE FRACTURE SAFETY DEVICE

[75] Inventors: Herbert Ziplies, Kamen; Werner Pyschik, Dortmund, both of Fed. Rep. of Germany

[73] Assignee: O & K Orenstein & Koppel Aktiengesellschaft, Berlin, Fed. Rep. of Germany

[21] Appl. No.: 878,915

[22] Filed: Feb. 17, 1978

[30] Foreign Application Priority Data

Feb. 23, 1977 [DE] Fed. Rep. of Germany ..... 2707630

[51] Int. Cl.[3] ..... F15B 11/00

[52] U.S. Cl. ..... 91/518; 60/406; 91/447; 91/459; 91/461

[58] Field of Search ..... 91/1, 517, 518, 459, 91/447, 461; 60/406

[56] References Cited

U.S. PATENT DOCUMENTS

| | | | |
|---|---|---|---|
| 3,125,856 | 3/1964 | Branson | 91/451 |
| 3,960,286 | 6/1976 | Spooner | 91/517 |
| 4,031,813 | 6/1977 | Walters | 91/433 |
| 4,091,715 | 5/1978 | Ouderka | 91/1 |
| 4,102,248 | 7/1978 | Martz | 91/361 |

FOREIGN PATENT DOCUMENTS 2352742 5/1974 Fed. Rep. of Germany .

*Primary Examiner*—Abraham Hershkovitz
*Attorney, Agent, or Firm*—Martin A. Farber

[57] ABSTRACT

An electronically controlled pipe fracture safety device for operating devices which are fed by a hydraulic pump and which are actuated by a control slide value by means of hydraulic cylinders. Control lines branch off from lines which lead from the hydraulic pump via a control slide valve to the hydraulic cylinders, the control lines feeding the hydraulic medium to a differential flow monitor, on the piston of which a permanent magnet is fastened. The latter, by means of a reed contact as a result of a pressure difference existing between the control lines, which pressure difference is brought about by damage or fracture of a line, produces a signal in the NOR gate, the latter forming the input of a scoring logic. This signal retransmits a self-holding signal to NAND-gates which form a flip-flop. The self-holding signal causes deenergization of a relay and consequently an interruption of the current flow to the control slide valve and brings about the locking position of the latter.

4 Claims, 3 Drawing Figures

ELECTRICALLY CONTROLLED PIPE FRACTURE SAFETY DEVICE

Figure 1:
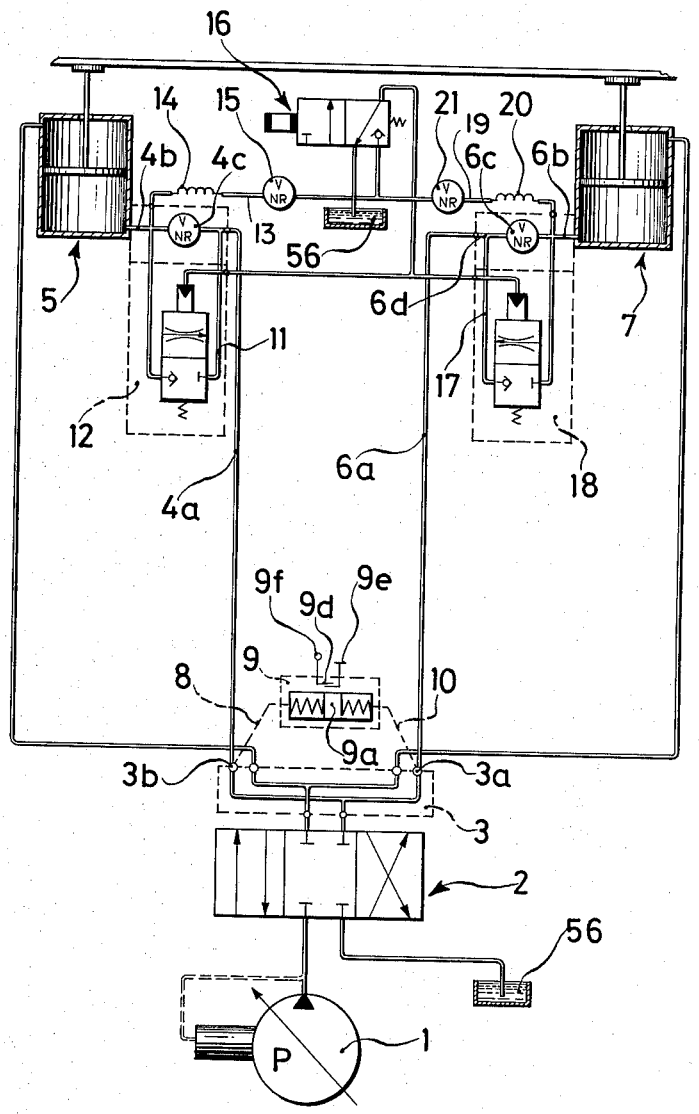

According to the invention an electronically controlled pipe fracture safety device for operating devices which are fed by a hydraulic pump and which are actuated by a control slide value with hydraulic cylinders, is provided in the manner that control lines (8, 10) branch off fron lines (4*a*, 6*a*) which lead from the hydraulic pump (1) via a control slide valve (2) to the hydraulic cylinders (5, 7), which control lines feed the hydraulic medium to a differential flow monitor (9), on the piston (9*a*) of which a permanent magnet (9*b*) is fastened, the latter, by means of a reed contact (9*d*) as a result of a pressure difference existing between the control lines (8, 10), which pressure difference is brought about by damage or fracture of a line (4*a* or 6*a*, respectively), produces a signal in the NOR gate (23), the latter forming the input of a scoring logic, which signal retransmits a self-holding or self-locking signal to NAND-gates (25, 26), the latter forming a flip-flop, which self-holding signal causes a dropout or deenergization of a relay (29) and consequently an interruption of the current flow to the control slide valve (16) and brings about the locking position of the latter. Still further with the electronically controlled pipe fracture safety device according to the invention in the lines (4*a*, 6*a*) which lead to the hydraulic cylinders (5, 7) restrictors (80*a* or 80*b*, respectively) are arranged between connections (3*a*, 3*c* or 3*b*, 3*d*, respectively), that in the by-pass which is arranged between the connections (3*a*, 3*c*) adjustable throttles (14*b*, 14*c*) are arranged and in the by-pass that is arranged between the connections (3*b*, 3*d*) adjustable throttles (14, 14*a*) are arranged.

Yet further with the electronically controlled pipe fracture safety device according to the invention a release of the locking position of the NAND-gates (25, 26) which form the flip-flop takes place manually by means of a key button (33).

The invention relates to an electronically controlled pipe break or fracture safety device for operating devices which are fed by a hydraulic pump and actuated or operated by a control slide valve by means of hydraulic cylinders.

A pipe fracture safety device for hydraulic excavators is known (German Offenlegeschrift OS No. 2 352 742), with which the hydraulic oil which stands under high pressure is led in tube- and pipelines. When one of the lines crack, the equipment drops or falls down by means of the positively controlled operating cylinder with the lowering speed which is preselected by the control slide valve or with the maximum lowering speed. Only if the control slide valve goes into the zero or neutral position does the equipment lock.

The task lying at the basis of the invention is to provide a pipe fracture safety device which is suited likewise for high pressure tubes and pipe lines, which guarantees that the operated or actuated operating device after a fracture occurring in a line or a tube instantaneously comes to a standstill, independent of the position of the control slide valve.

The solution of this task is brought about in accordance with the invention, in the manner that control lines branch off from lines which lead from the hydraulic pump via a control slide valve to the hydraulic cylinders, which control lines feed the hydraulic medium to a differential flow monitor, on the piston of which a permanent magnet is fastened, the latter, by means of a reed contact as a result of a pressure difference existing between the control lines, which pressure difference is brought about by damage or fracture of a line, produces a signal in the NOR gate, the latter forming the input of a scoring logic, which signal retransmits a self-holding or self-locking signal to NAND-gates, the latter forming a flip-flop, the self-holding signal causing a drop-out or deenergization of a relay and consequently an interruption of the current flow to the control slide valve and bringing about the locking position of the latter.

Further particulars of the invention arise from the following description and from the claims.

The advantage of the invention resides in that the safety device of the equipment steps into action against dropping down, independent of the position of the control slide valve, i.e. independent of the lifting- and lowering-speed, even with pressure drops caused by the smallest changes of the flow speeds. This advantage does not concern the pressure of the flowing medium per se, but rather a difference of the pressure drops in the feed lines to the hydraulic cylinders which actuate the operating devices is used for its arresting or switching off.

Figure 2:
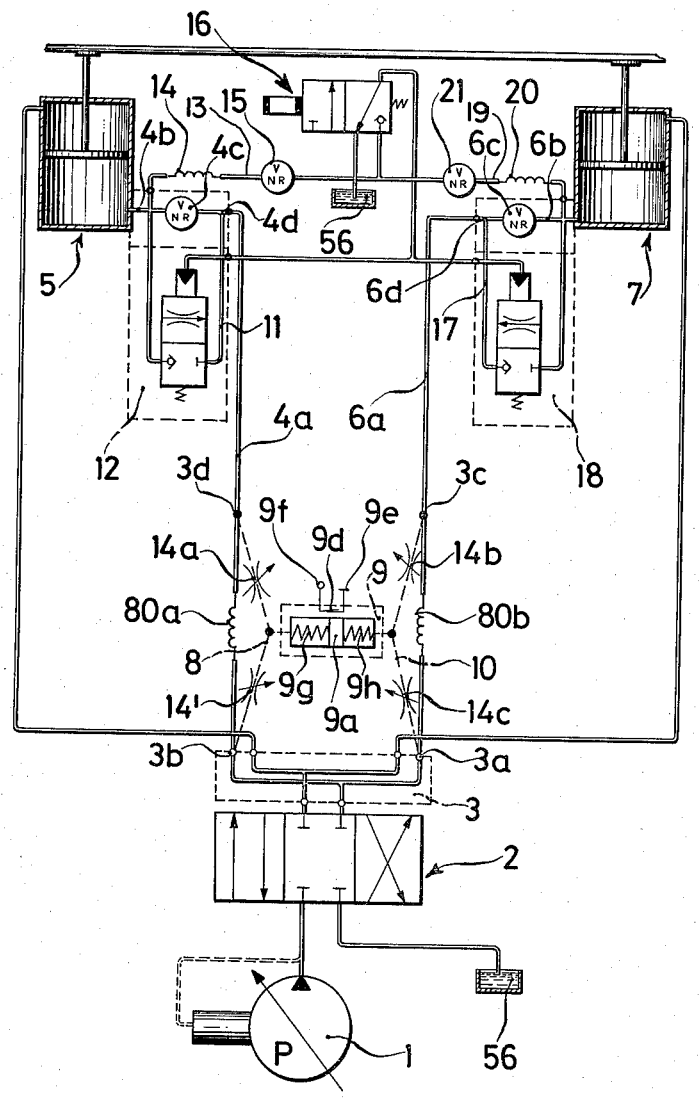
Figure 3:
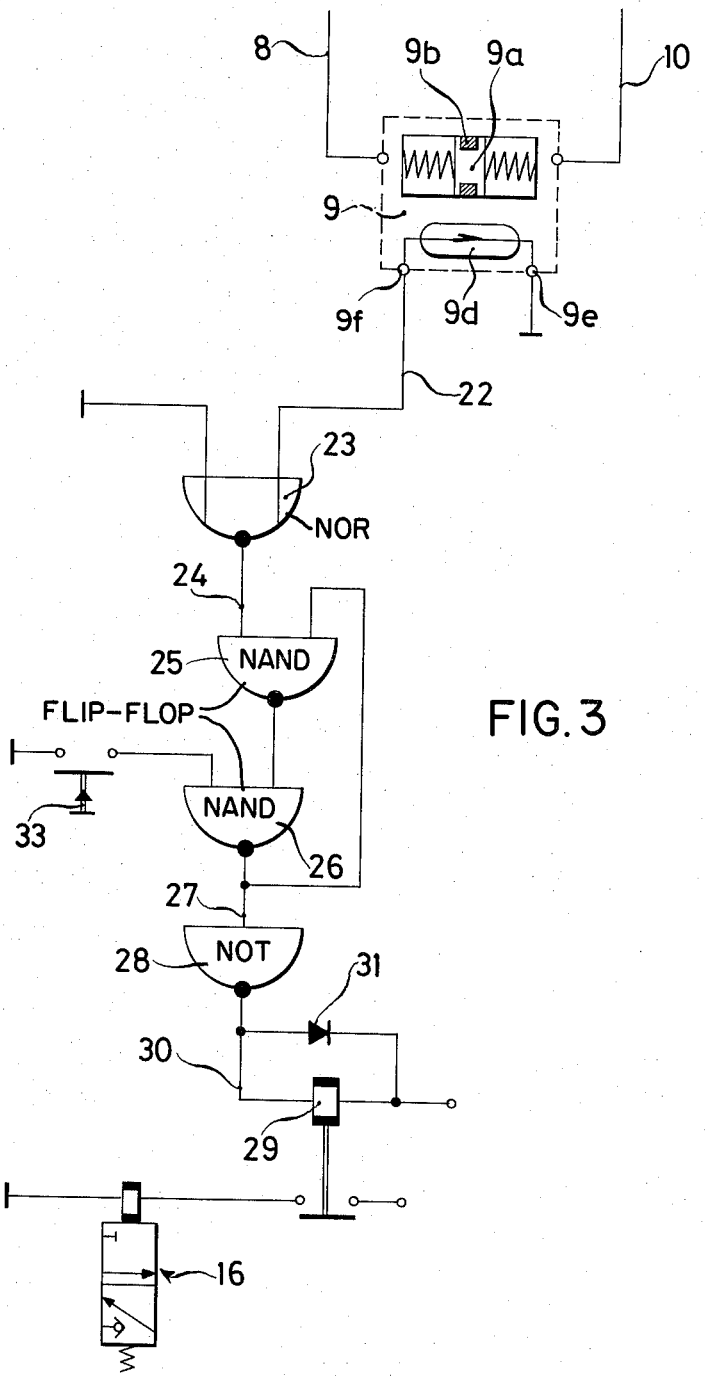

In the drawings, one embodiment example of the invention is illustrated. It shows:

FIG. 1: a circuit diagram of the hydraulic operation of two parallel connected hydraulic cylinders with a pipe fracture safety device, FIG. 2: a circuit diagram of the hydraulic operation of two parallel connected hydraulic cylinders with a pipe fracture safety device under consideration of different pressure drops in the feed lines, FIG. 3: a circuit diagram of the electronic control of the pipe fracture safety device for two or more hydraulic cylinders which are connected in parallel.

Hydraulic or pressure oil is fed from the hydraulic pump 1 via the distributing regulator or control slide valve 2 the distributor link 3, the lines 4*a* and 4*b* and the non-return valve 4*c* to the hydraulic cylinder 5 and via the lines 6*a* and 6*b* and the non-return valve 6*c* to the hydraulic cylinder 7. From the connection 36 of the distributor line 3, the line 4*a* is connected via a control line 8 with the differential flow monitor or detector 9 and from the connection 3*a* of the distributor link 3 the line 6*a* is connected via a control line 10 with the differential flow monitor 9. The line 4*a* which leads to the hydraulic cylinder 5 is connected with the non-return valve 4*c L* via the connection *4d* and the line 11 with the non-return or check valve 12. The check valve 12 is connected via a line 13, a throttle 14 and a non-return valve 15 with the control slide valve 16. The line 6*a* leading from the hydraulic cylinder 7 is connected with the non-return valve 6*c* over the line 17 with the non-return or check valve 18. The check valve 18 is connected via a line 19, a throttle 20 and a non-return valve 21 with the control slide valve 16. The differential flow monitor 9 has a piston 9*a* on which a permanent magnet 9*b* (see FIG. 3) is secured, by means of which magnet a reed contact 9*d* is actuated. Via the connections 9*e* and 9*f* the differential flow monitor 9 is connected with the evaluating or scoring logic in the form of an electronic control, by means of the electrical line 22 with a NOR gate 23. The line 24 leads to the NAND-gates 25 and 26 which are assembled or combined into a flip-fllop. The negator or NOT gate 28 which is connected by means of the line 27 with the NAND-gate 26, upon a flow drop or breakdown causes the relay 29 to remain released or deenergized, the relay 29 being connected via the line 30 with the negator or NOT gate 28. The diode 31 has the function of an erasing or clearing diode, which cancels the induced voltage of the relay 29 during the switching off. The control slide valve 16 remains in locking position until the electronic circuit is again released or unlocked via the pushbutton 33.

The manner of operation is as follows:

Upon break or fracture e.g. to the line 6a, the pressure drop as a consequence of a change of the flow speed in the control line 10 becomes smaller than in the control line 8, so that the control piston **9*a* of the differential flow monitor 9 moves in the direction of the control line 10. The permanent magnet 9*b*, which is secured to the piston 9*a*, now opens the reed contact switch 9*d*, i.e., the logic information HL lies on the input of the NOR gate 23, so that the input of the NAND gate 25 receives an L-signal and thus likewise the output, NAND gate 26, so that the flip-flop 25, 26 goes into a self-holding or self-locking condition. Via the negator or NOR gate 28, the relay 29 releases or deenergizes, so that the current flow to the control slide valve 16 is interrupted and the latter goes into locking or blocking position. Since the NOT gate 28 insures that the relay 29 remains dropped out or deenergized with the flow failure, this means that when one of the lines 4*a* or 6*a* breaks, likewise the control slide valve 16 remains in locking or blocking position and the hydraulic cylinders 5 and 7 do not independently lower or drop (so-called safety circuit). The control slide valve 16 remains in its locking position until the electronic circuit is again released by means of the key button 33. In the locking position of the control slide valve 16 control oil no longer flows to the non-return check valves 12 and 18, so that these valves close. Since the check valves 12 and 18 are arranged directly on the hydraulic cylinders 5 and 7, consequently they isolate or close off the oil flow from the hydraulic cylinders 5 and 7. If a fracture of one of the control lines 8 or 10 occurs, likewise the pressure on the side of the fractured line reduces, which has the consequence that the piston 9*a* of the differential flow monitor 9 switches, which has the result that the logic information "tube fracture" is transmitted to the electrical control, the latter closing the check valves 12 and 18. With a break or fracture of the control lines 13 and 19 which lead to the control slide valve 16 from the hydraulic cylinders 5 and 7, the throttles 14 and 20 insure that the operating device lowers only as fast as limited or caused by the cross-section of the throttles 14 and 20. Instead of the throttles 14 and 20, also tube or hose break safety devices can be used, since here a very small oil quantity flows. The non-return valves 15 and 21 prevent a manual or reciprocal influencing of the pressure in the control lines 8 and 10**.

There occurs in practice by means of different tolerances in the lines **4*a* and 6*a* and in the channels 4*b* and 6*b* as well as in the distributor link 3 differing pressure drops by the flow speed of the pressure oil or hydraulic. With the aid of the control lines 8 and 10 a by-pass is produced parallel to the lines 4*a* and 6*a*. The restrictors or attenuators 80*a* and 80*b* which are arranged between the connections 3*b* and 3*d* or 3*a* and 3*c*, respectively, of the bypasses, determine the pressure oil quantity flowing through the control lines 8 and 10. The four adjustable throttles 14', 14*a*, 14*b*, 14*c*, during maximum speed of the pressure oil provide for the pressure balance or equalization which is required for the differential flow monitor 9, since a pressure drop is produced on them for the back and forth movement independent from each other, and dependent thereon a pressure equalization is produced. With a flow speed which is smaller than the maximum, the control piston 9*a* with the reed contact 9*d* is held by springs 9*g* and 9*h* in a stable middle position. With fracture of one of the lines 4*a* or 6*a* the pressure equalization is cancelled and the differential flow monitor 9** sends a signal to the scoring logic again.

We claim:

1. An electronically controlled pipe fracture safety device for operating devices which are fed by a hydraulic pump and which are actuated by a control slide valve by means of hydraulic cylinders, comprising a hydraulic system comprising, a hydraulic pump, hydraulic cylinders being operatively connected to the operating devices, first lines leading from said hydraulic pump to a first chamber of each of said hydraulic cylinders, respectively, a first control slide valve operatively connected to said first lines between said hydraulic pump and said hydraulic cylinders, control lines branching off from said first lines, respectively, means comprising a differential pressure monitor connected to said control lines and having a slidable differential pressure actuated piston, said means for monitoring the entire hydraulic system, a permanent magnet secured to said piston, a control slide valve means operatively fed with and operatively controlled by a current flow and operatively connected to said hydraulic cylinders, said control slide valve means for being in a locking position thereof without current flow thereto, said locking position preventing escape of hydraulic fluid from said first chamber of each of said hydraulic cylinders, a logic circuit means including, an input thereto comprising a NOR gate, and NAND gates forming a flip-flop operatively connected to said NOR gate, a relay operatively connected to said flip-flop and to said control slide valve means, said logic circuit means including a reed contact switch means operatively connected to said NOR gate and cooperatively disposed adjacent said permanent magnet, such that upon a pressure difference between said control lines upon leakage in one of said first lines, said piston is displaced by the pressure difference and said magnet actuates said reed contact switch means so that a signal is produced in said NOR gate, whereupon said signal retransmitting a self-locking signal to said NAND gates causing a locking position of said NAND gates, in turn causing a drop-out of said relay and an interruption of the current flow to said control slide valve means and effecting the locking position of the latter.

2. The electronically controlled pipe fracture safety device according to claim 1, wherein each of said first lines which lead to the hydraulic cylinders has two spaced connections, a restrictor disposed between said two connections in each of said first lines, respectively, a by-pass disposed between said two connections of each of said first lines, respectively, two adjustable throttles connected in each of said by-pass between said two connections of each of said first lines, respectively.

3. The electronically controlled pipe fracture safety device according to claim 2, wherein said differential pressure monitor is connected between said two adjustable throttles of each of said by-pass.

4. The electronically controlled pipe fracture safety device according to claim 1, further comprising pushbutton for manually releasing the locking position of said NAND gates.

* * * * *